US009376279B2

(12) United States Patent
Wada

(10) Patent No.: US 9,376,279 B2
(45) Date of Patent: Jun. 28, 2016

(54) SHEET FEEDING DEVICE AND IMAGE FORMING APPARATUS

(71) Applicant: KYOCERA Document Solutions Inc., Osaka (JP)

(72) Inventor: Hiroshi Wada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/874,979

(22) Filed: Oct. 5, 2015

(65) Prior Publication Data

US 2016/0096699 A1 Apr. 7, 2016

(30) Foreign Application Priority Data

Oct. 6, 2014 (JP) ..... 2014-205631

(51) Int. Cl.
*B65H 9/08* (2006.01)
*B65H 9/06* (2006.01)
*B65H 5/06* (2006.01)

(52) U.S. Cl.
CPC ..... *B65H 9/08* (2013.01); *B65H 5/068* (2013.01); *B65H 9/06* (2013.01)

(58) Field of Classification Search
CPC ..... B65H 9/04; B65H 9/06; B65H 9/08; B65H 2405/114; B65H 2405/1142; B65H 2405/1116; B65H 2511/10; B65H 2511/12
USPC ..... 271/171, 9.09
See application file for complete search history.

(56) References Cited

U.S. PATENT DOCUMENTS 5,632,477 A * 5/1997 Morinaga ..... B65H 1/08 271/127
2004/0051234 A1* 3/2004 Lien ..... B65H 1/04 271/171
2004/0188924 A1* 9/2004 Ito ..... B65H 1/04 271/171
2005/0062218 A1* 3/2005 Murakami ..... B65H 1/04 271/171
2006/0082044 A1* 4/2006 Aida ..... B65H 1/04 271/145
2006/0237897 A1* 10/2006 Terao ..... B65H 3/0661 271/145
2007/0138737 A1* 6/2007 Yamada ..... B65H 1/04 271/171
2013/0056925 A1* 3/2013 Hsu ..... B65H 1/04 271/171
2014/0191464 A1* 7/2014 Watanabe ..... B65H 1/04 271/171
2015/0054218 A1* 2/2015 Ishida ..... B65H 9/101 271/250

FOREIGN PATENT DOCUMENTS

EP 2 014 588 B1 12/2014
JP 2008-273635 A 11/2008
JP 2009-018931 A 1/2009
JP 2013-112523 A 6/2013

* cited by examiner

*Primary Examiner* — David H Bollinger
(74) *Attorney, Agent, or Firm* — Studebaker & Brackett PC

(57) ABSTRACT

A sheet feeding device includes a manual bypass tray, a pair of side-fences and restricting members. On the manual bypass tray, a sheet conveyed to an apparatus main body is placed. The pair of side-fences are arranged slidable in a width direction orthogonal to a conveying direction of the sheet so as to mutually approach/separate on the manual bypass tray. The restricting members are arranged attachable to/detachable from the pair of side-fences. Each of the restricting members includes a first engaging part and a preventive portion. The first engaging part is engaged with the manual bypass tray to restrict slide of each of the pair of side-fence in the width direction. The preventive portion is arranged so as to be separated upwardly from the manual bypass tray to prevent the sheet on the manual bypass tray from uplifting.

12 Claims, 10 Drawing Sheets

SHEET FEEDING DEVICE AND IMAGE FORMING APPARATUS

INCORPORATION BY REFERENCE

This application is based on and claims the benefit of priority from Japanese Patent application No. 2014-205631 filed on Oct. 6, 2014, the entire contents of which are incorporated herein by reference.

BACKGROUND

The present disclosure relates to a sheet feeding device feeding a sheet to an image forming apparatus and the image forming apparatus including this sheet feeding device.

In an image forming apparatus, such as a copying machine or a printer, a long irregular-sized sheet (e.g. its length is about 120 mm) (hereinafter, called as a "long sheet") may be conveyed from a manual bypass tray arranged on a side face of the image forming apparatus into an apparatus main body.

On the manual bypass tray, a pair of side-fences sliding in a width direction orthogonal to a conveying direction of the long sheet to mutually approach/separate are arranged. The manual bypass tray is configured so that the long sheet can be set in a state matched at the center in the width direction of the manual bypass tray by these side-fences.

However, in the manual bypass tray, because a rear end portion of the long sheet is not placed on the tray, a problem causing a skew of the long sheet by the own weight of this rear end portion occurs. If a degree of the skew of the long sheet becomes high, the pair of side-fences moves from predetermined positions to the outside to spread in the width direction and the side-fences cannot match the long sheet. Accordingly, there are problems that the long sheet is further skewed and uplifting of the long sheet on the tray is caused.

Thereupon, to solve such problems, for example, there is a sheet feeding device, in which a sheet holding member attachable to/detachable from a manual bypass tray is arranged on a pulled-out extension guide and a lib is formed along the extension guide at a side facing to the extension guide of the sheet holding member.

Alternatively, there is a sheet feeding device having a long tray arranged above a manual bypass tray to support a rear portion of a long sheet and a guide member guiding the long sheet above the long tray when setting or feeding the sheet.

Moreover, there is a sheet holding device including a movement restricting member restricting a side-fence from moving from a predetermined position in a width direction and a height restricting member arranged above a sheet holding face and bridged in the width direction to restrict a height of the sheet from the sheet holding face and to prevent uplifting of a long sheet.

However, in the above-mentioned sheet feeding devices, it is impossible to prevent the side-fence from moving from the predetermined position in the width direction due to a load of the long sheet when feeding, it is still feared that matching deterioration of the long sheet and a skewed feeding of the long sheet due to uplifting of the long sheet are caused.

In addition, in the above-mentioned sheet holding device, although the movement restricting member and the height restricting member can prevent a skew of the long sheet according to floating of the long sheet, because the movement restricting member and the height restricting member have large and complex mechanisms, there are problems that attaching/detaching work takes labor and placing during non-use troubles.

SUMMARY

In accordance with the present disclosure, a sheet feeding device includes a manual bypass tray, a pair of side-fences and restricting members. On the manual bypass tray, a sheet conveyed to an apparatus main body is placed. The pair of side-fences are arranged slidable in a width direction orthogonal to a conveying direction of the sheet so as to mutually approach/separate on the manual bypass tray. The restricting members are arranged attachable to/detachable from the pair of side-fences. Each of the restricting members includes a first engaging part and a preventive portion. The first engaging part is engaged with the manual bypass tray to restrict slide of each of the pair of side-fence in the width direction. The preventive portion is arranged so as to be separated upwardly from the manual bypass tray to present the sheet from uplifting on the manual bypass tray.

In accordance with the present disclosure, an image forming apparatus includes the above-mentioned sheet feeding device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference to the drawings, a sheet feeding device and an image forming apparatus according to an embodiment of the present disclosure will be described.

Figure 1:
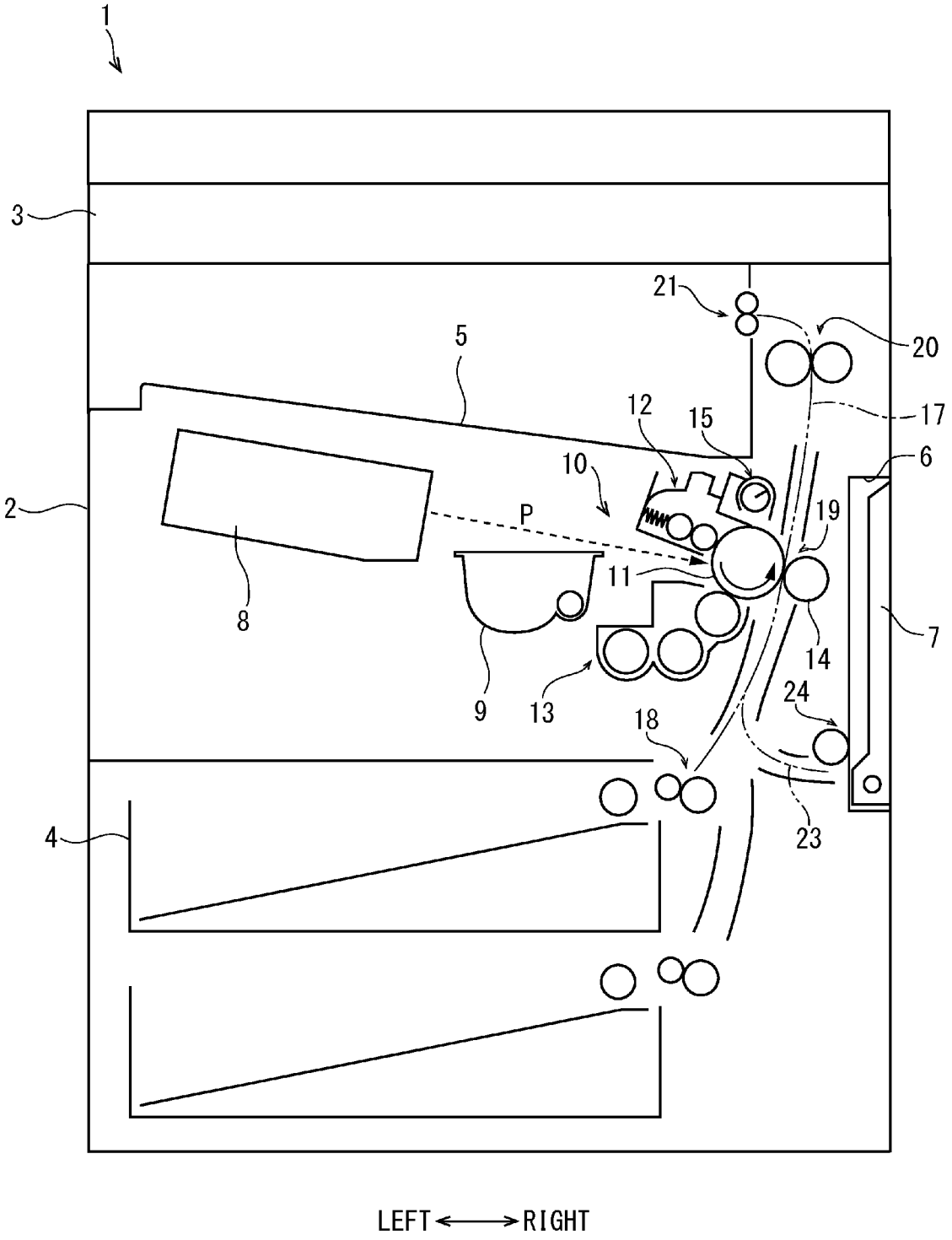
FIG. 1 is a sectional view schematically showing inner structure of an image forming apparatus including a sheet feeding device in accordance with an embodiment of the present disclosure.

First, with reference to FIG. 1, entire structure of an image forming apparatus 1 will be described. FIG. 1 is a sectional view schematically showing inner structure of the image forming apparatus 1 in accordance with the embodiment of the present disclosure. Incidentally, hereinafter, it will be described so that the front side of the image forming apparatus 1 is positioned at the near side of FIG. 1 and that left and right directions is defined as viewed from the front side of the image forming apparatus 1.

As shown in FIG. 1, the image forming apparatus 1 includes an apparatus main body 2 having a roughly box-like exterior shape. In an upper end part of the apparatus main body 2, an image reading part is arranged. In a lower part of the apparatus main body 2, sheet feeding cartridges 4 storing a sheet (not shown) are housed. At the front side of an upper part of the apparatus main body 2, an ejected sheet tray 5 is arranged. In a right side face of the apparatus main body 2, a concave part 6 is formed. To the concave part 6, a sheet feeding device 7 is turnably supported at a lower end part as a fulcrum.

Inside the apparatus main body 2, an exposure device 8 composed of a laser scanning unit (LSU) is located below the ejected sheet tray 5. At a right side of the exposure device 8, a toner container 9 containing a replenishment toner is located. At a right side of the toner container 9, an image forming part 10 is arranged.

In the image forming part 10, a photosensitive drum 11 as an image carrier is rotatably arranged. Around the photosensitive drum 11, a charging device 12, a developing device 13, a transferring roller 14 and a cleaning device 15 are located along a rotating direction (an arrow direction in FIG. 1) of the photosensitive drum 11.

Moreover, inside the apparatus main body 2, a conveying path 17 for the sheet from the sheet feeding cartridge 4 to the ejected sheet tray 5 is arranged. In the conveying path 17, a sheet feeding part 18, a transferring part 19, a fixing device 20 and a sheet ejecting part 21 are arranged in order from an upstream side in a conveying direction of the sheet. The transferring part 19 is composed of the photosensitive drum 11 and the transferring roller 14. The fixing device fixes a toner image on the sheet by heating and pressuring. To the conveying path 17, a manual bypass conveying path 23 extending from the sheet feeding device is joined between the sheet feeding part 18 and the transferring part 19. At a downstream side from the manual bypass conveying path 23, a manual bypass sheet feeding part 24 is arranged.

Next, image forming operation of the image forming apparatus 1 having such a configuration will be described.

First, the image reading part 3 optically reads document image to create image data. The exposure device 8 irradiates the photosensitive drum 11 with a laser light corresponding to the image data (refer to a broken line arrow P). Thereby, an electrostatic latent image based on the image data is formed on the surface of the photosensitive drum 11 electrically charged at a predetermined potential by the charger 12. The electrostatic latent image is developed to the toner image with the toner supplied from the toner container 9 by the developing device 13.

On the other hand, the sheet fed from the sheet feeding cartridge 4 by the sheet feeding part 18 or from the sheet feeding device 7 by the manual bypass sheet feeding part 24 is conveyed to the transferring part 19 in a suitable timing for the above-mentioned image forming operation. Then, in the transferring part 19, the toner image on the photosensitive drum 11 is transferred onto the sheet. The sheet with the transferred toner image is conveyed to a downstream side on the conveying path 17 to enter a nip part of the fixing device 20, and then, the toner image is fixed on the sheet in the fixing device 20. The sheet with the fixed toner image is ejected from the sheet ejecting port 21 onto the ejected sheet tray 5. The toner remained on the photosensitive drum 11 is collected by the cleaning device 15.

Figure 2:
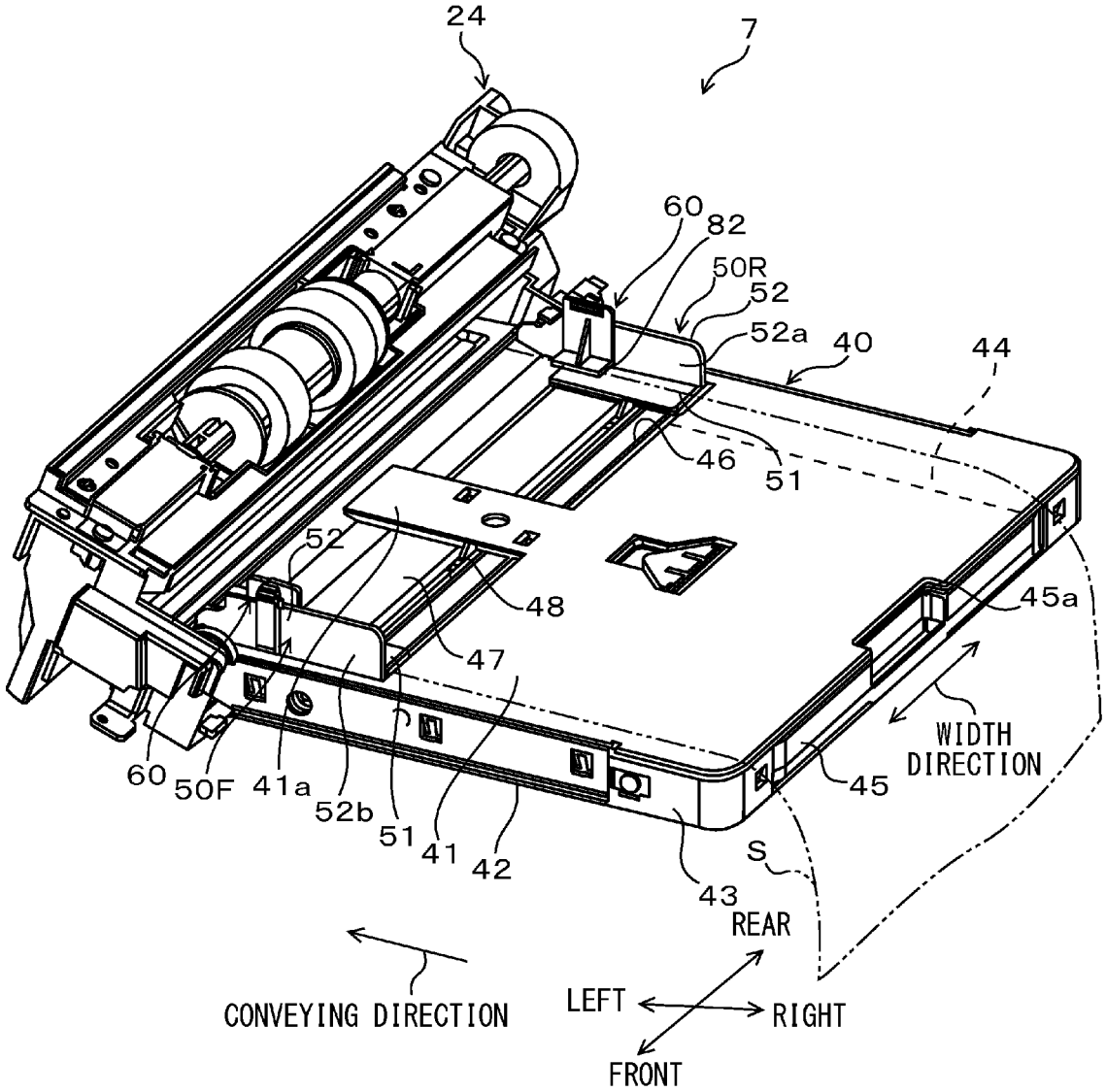
FIG. 2 is a perspective view showing entire structure of the sheet feeding device in accordance with the embodiment of the present disclosure.
Figure 3:
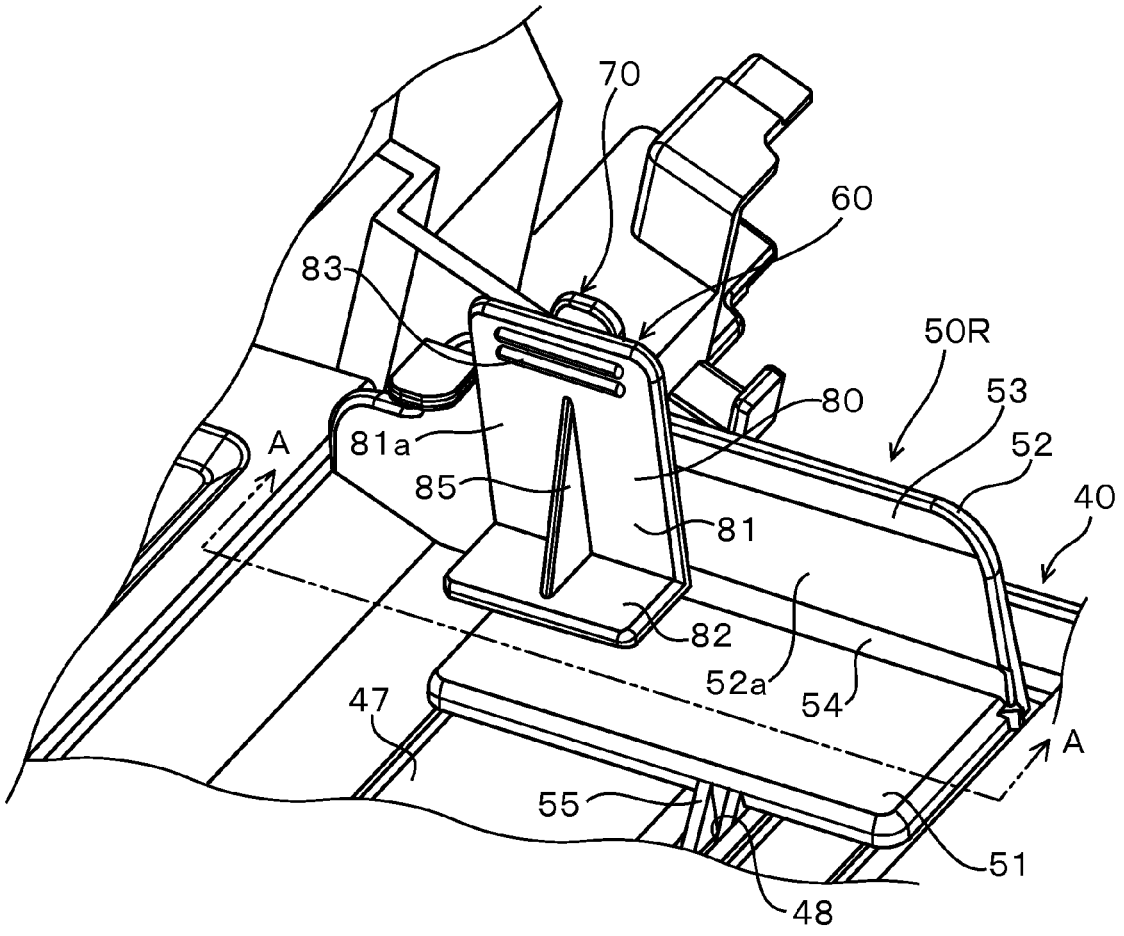
FIG. 3 is an enlarged view showing main components of the sheet feeding device in accordance with the embodiment of the present disclosure.
Figure 4:
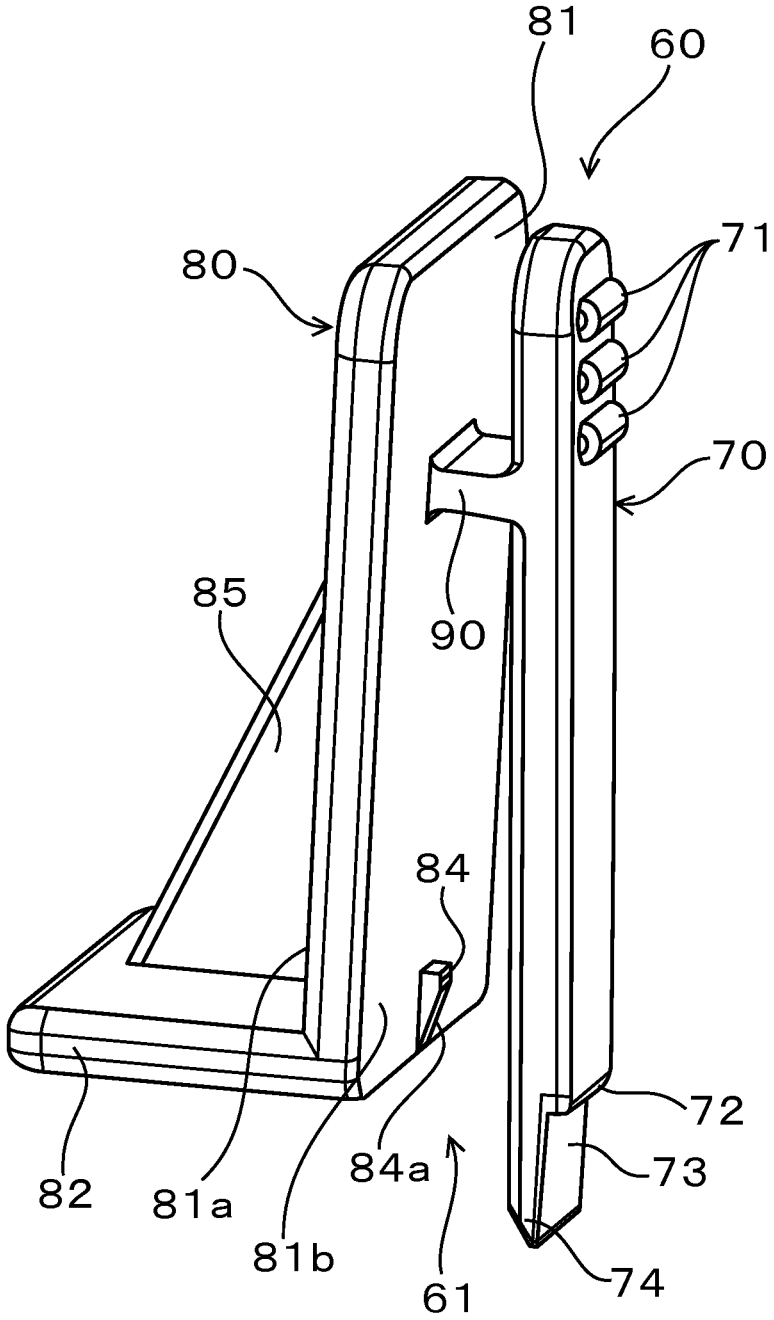
FIG. 4 is a perspective view showing a restricting member of the sheet feeding device in accordance with the embodiment of the present disclosure.

Next, with reference to FIGS. 2-4, entire structure of the sheet feeding device 7 in accordance with the embodiment of the present disclosure will be described in detail. FIG. 2 is a perspective view showing entire structure of the sheet feeding device 7, FIG. 3 is an enlarged view showing main components of the sheet feeding device 7 and FIG. 4 is a perspective view showing a restricting member 60.

As shown in FIG. 2, the sheet feeding device 7 includes a manual bypass tray 40, a pair of front and rear side-fences 50F and 50R, and the restricting members 60. On the manual bypass tray 40, a long sheet S is placed. The pair of front and rear side-fences 50F and 50R match a position in a width direction of the long sheet S placed on the manual bypass tray 40. The restricting members 60 are attachably/detachably arranged at the downstream side in a sheet conveying direction from the side-fences 50F and 50R.

The manual bypass tray 40 is a hollow member having a rectangular plane shape and a predetermined thickness. The manual bypass tray 40 is integrally formed of an upper plate 41, a lower plate 42, a front side plate 43, a rear side plate 44 and a right side plate 45. The upper plate 41 and the lower plate 42 are located at an upper side and a lower side of the manual bypass tray 40. The front side plate 43 and the rear side plate 44 are located at both sides in a sheet width direction. The right side plate 45 is located at the upstream side in the sheet conveying direction. In a center part in the sheet width direction of the right side plate 45, a depression part 45*a* is formed.

In the upper plate 41, a rectangular penetration hole 46 is formed at the downstream in the sheet conveying direction and a sheet guide part 41*a* is extended at a roughly center part in the sheet width direction of the penetration hole 46. Inside the penetration hole 46, a slide plate 47 is attached and, in the slide plate 47, a guide groove 48 is formed in the sheet width direction. At both end parts of the slide plate 47, a plurality of (e.g. four) engaged grooves (engaged recess parts) 49 as a first engaged part are formed in parallel in the sheet width direction at the downstream side in the sheet conveying direction from the guide groove 48 (refer to FIGS. 5-8). That is, the engaged recess parts 49 as the first engaged part are arranged on the upper plate 41 of the manual bypass tray 40.

On the front side plate 43 and the rear side plate 44, supporting shafts (not shown) protruding to the outside are coaxially formed at an end part (a left end part) at the downstream side in the sheet conveying direction. The supporting shafts are axially supported by front and rear side faces of the image forming apparatus 1. Thereby, the manual bypass tray 40 is configured so as to be turnable at the supporting shafts as fulcrums between a housed position and a manual bypass position (refer to FIG. 2). The manual bypass tray 40 turned to the housed position is housed in the concave part 6 in an erected state. The manual bypass tray 40 turned to the manual bypass position is projected in a roughly horizontal direction from the image forming apparatus 1. Incidentally, such a turning operation is carried out by grasping the depression part 45*a* (refer to FIG. 2).

The side-fences 50F and 50R have L-shapes symmetrical with forward and backward directions. Each of the side-fences 50F and 50R includes a rectangular plate-like based part 51 and a side part 52. The based part 51 is formed along an upper face of the slide plate 47 of the manual bypass tray 40. The side part 52 is erected from an outside edge in the sheet width direction (the forward and backward directions) of the based part 51. The based part 51 and the side part 52 are formed so that respective end faces (right end faces) at the upstream side in the sheet conveying direction are matched with each other and an end face (a left end face) at the downstream side in the sheet conveying direction of the side part 52 is extended to the downstream side (a left side) in the sheet conveying direction from the based part 51. On an upper end part at an inside face 52*a*'s side of each side part 52, an inclined face 53 is formed so that its thickness becomes thinner in an upward direction. On a lower end part at the inside face 52*a*'s side of each side part 52, an engaged recess part 54 as a second engaged part is stepwisely formed.

Figure 8:
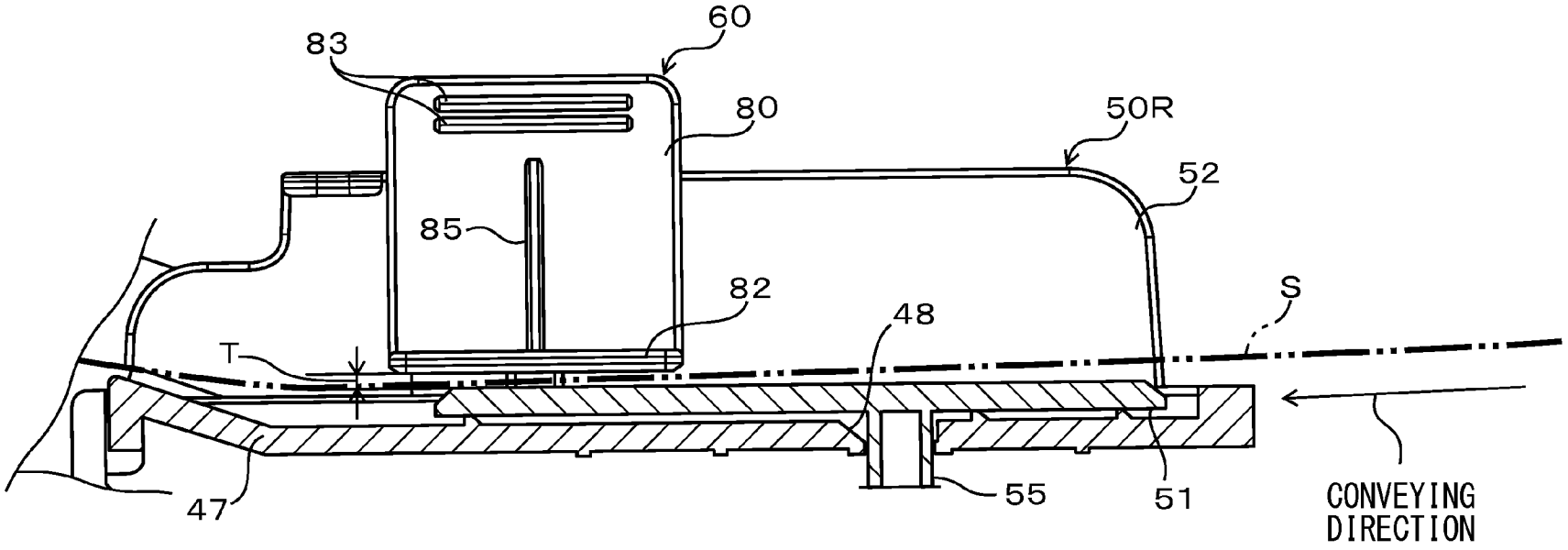
FIG. 8 is a sectional view showing the sheet feeding device as viewed along a two-dot chain line allow A-A of FIG. 3.

At a lower face side of the based part 51 of each of the side-fences 50F and 50R, a protruding piece 55 is formed so as to be engagable with the guide groove 48 formed on the slide plate 47 of the manual bypass tray 40 (refer to FIG. 8). Inside a hollowing part of the manual bypass tray 40, respective protruding pieces 55 engaged with the guide grooves 48 are connected by a rack and pinion mechanism (not shown) so that, for example, when one side-fence 50F is slid backwardly along the guide groove 48, another side-fence 50R is synchronously slid forwardly by same distance. That is, the side-fences 50F and 50R are arranged slidable in the width direction orthogonal to the conveying direction of the sheet to mutually approach/separate on the manual bypass tray 40 and configured so as to match the sheet at the center of the sheet width direction by sliding in mutual approaching/separating directions.

Each of the restricting members 60 is made of hard resin material with elasticity, such as ABS resin material, into a whole. The restricting members 60 include first fixing parts 70 arranged at positions facing to outside faces 52*b* of the side-fences 50F and 50R and second fixing parts 80 arranged at positions facing to the inside faces 52*a* of the side-fences 50F and 50R. The restricting members 60 are formed in clothespin-like shapes capable of sandwiching the side parts 52 the side-fences 50F and 50R.

Each first fixing part 70 is made of a plane piece elongated in upward and downward directions. On an outside face of an upper end part of each first fixing part 70, half-cylindrical ribs 71 are protruded at a plurality of (e.g. three) stages in the upward and downward directions. At an outside face side of a lower end part of each first fixing part 70, a projection piece part 73 is extended downwardly from a stage part 72. On a distal end part of the projection piece part 73, an engaging claw part 74 as a first engaging part is formed. At an inside face side of an upper part of each first fixing part 70, a connection part 90 is extended inwardly. Each first fixing part 70 is unified with each second fixing part 80 via the connection part 90.

Figure 6:
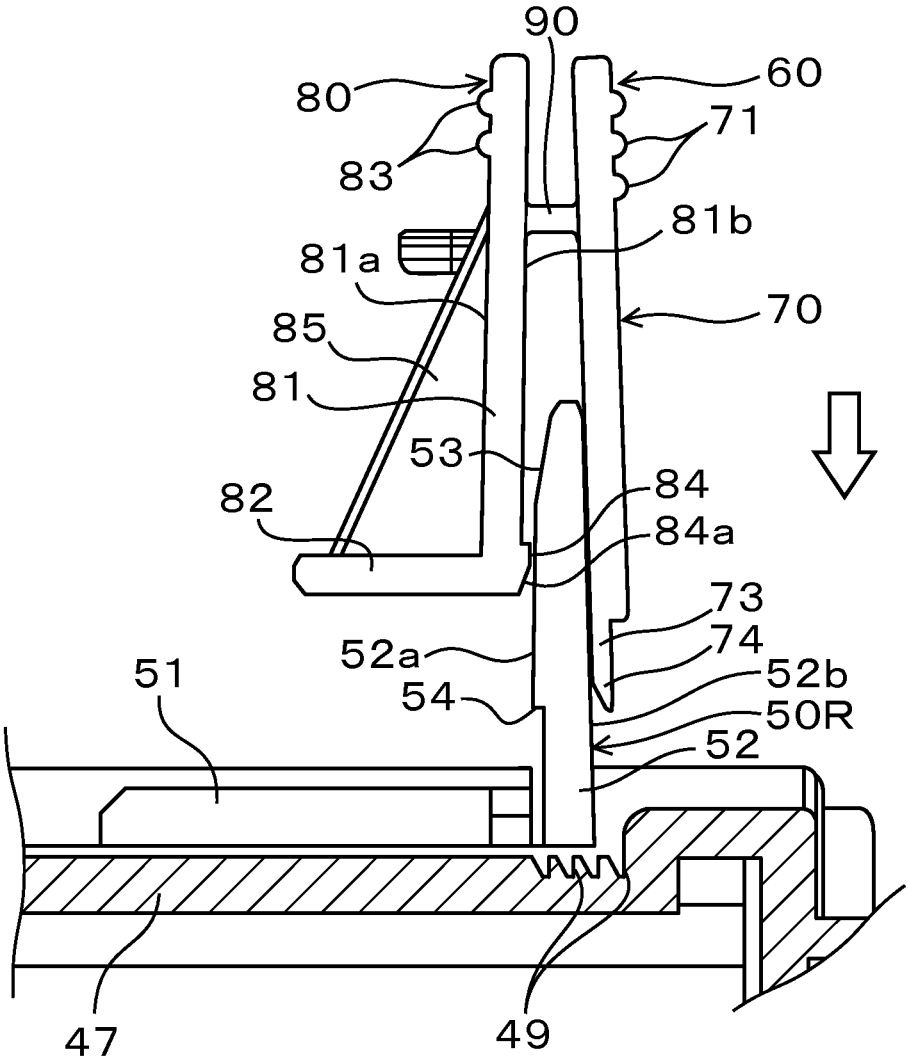
FIG. 6 is a sectional view showing the sheet feeding device, in a situation in the middle of attaching the restricting member to the side-fence, in accordance with the embodiment of the present disclosure.

Each second fixing part 80 is integrally formed of a flat plate-like fixing plate 81 formed in the upward and downward directions and a flat plate-like preventive portion 82 extending toward the inside in the horizontal direction on a lower end part of the fixing plate 81. The fixing plate 81 is formed so that its upper end is positioned at the same level as an upper end of each first fixing part 70 and its lower end is positioned slightly above the stage part 72 of each first fixing part 70. On an inside face 81*a* of an upper end part of each fixing plate 81, half-cylindrical ribs 83 are protruded at a plurality of (e.g. two) stages in the upward and downward directions. The preventive portion 82 is located, as shown in FIG. 6 and other figures, so as to face to the based part 51.

On an outside face 81*b* of the lower end part of each fixing plate 81, an engaging claw part 84 as a second engaging part is protruded at a center part in the sheet conveying direction. On the outside face of the engaging claw part 84, an inclined face 84*a* is formed so as to run downwardly and inwardly. The lower end of each fixing plate 81 and a lower end of each first fixing part 70 are separated via an aperture 61 and separation distance between a rear end face of the inclined face 84*a* and a front face of the first fixing part 70 is slightly smaller than a maximum thickness of the side part 52 of each of the side-fences 50F and 50R. Over the inside face 81*a* of each fixing plate 81 and an upper face of each preventive portion 82, a triangular abutting plate 85 is fixed and the abutting plate 85 is formed in a vertical direction orthogonal to the fixing plate 81 and the preventive portion 82.

Figure 5:
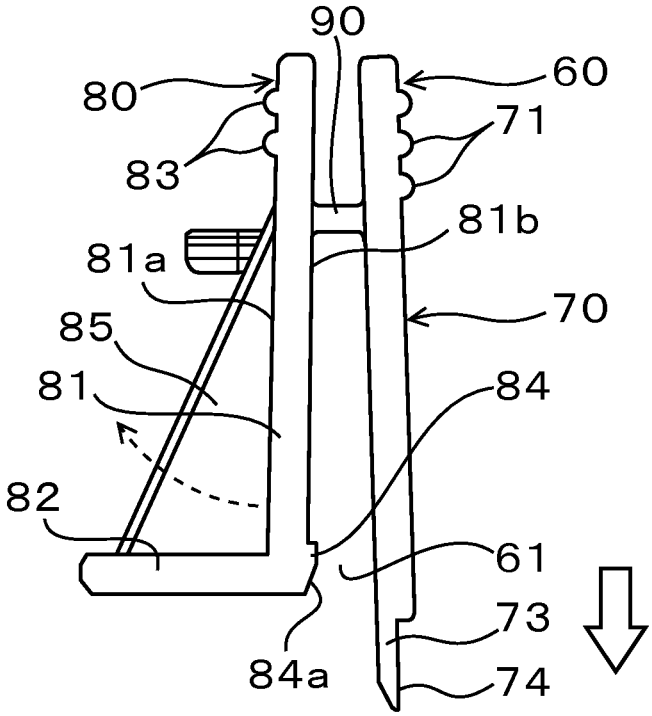
FIG. 5 is a sectional view showing the sheet feeding device, in a situation before the restricting member is attached to a side-fence, in accordance with the embodiment of the present disclosure.
Figure 5:
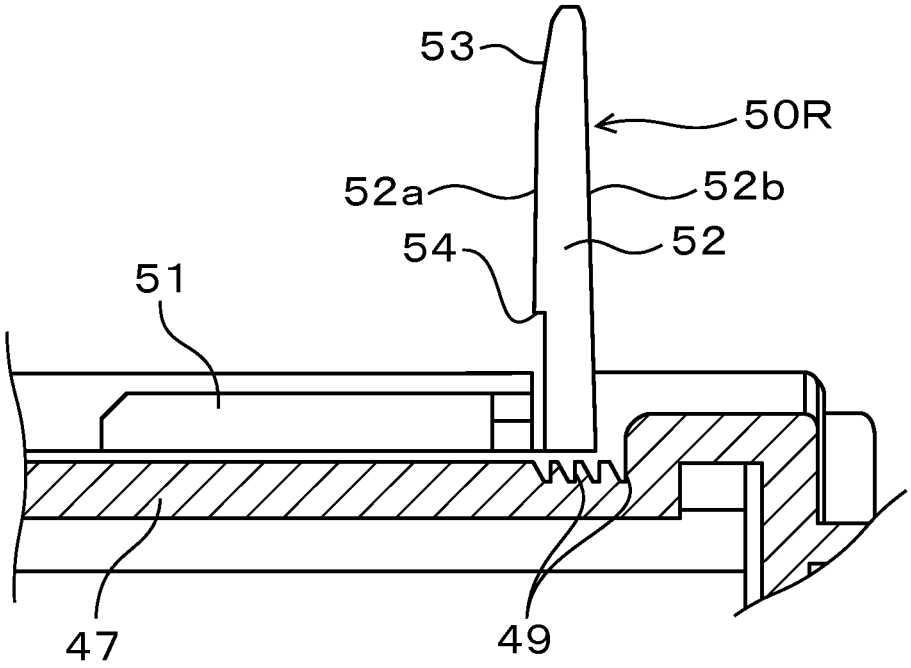
Figure 7:
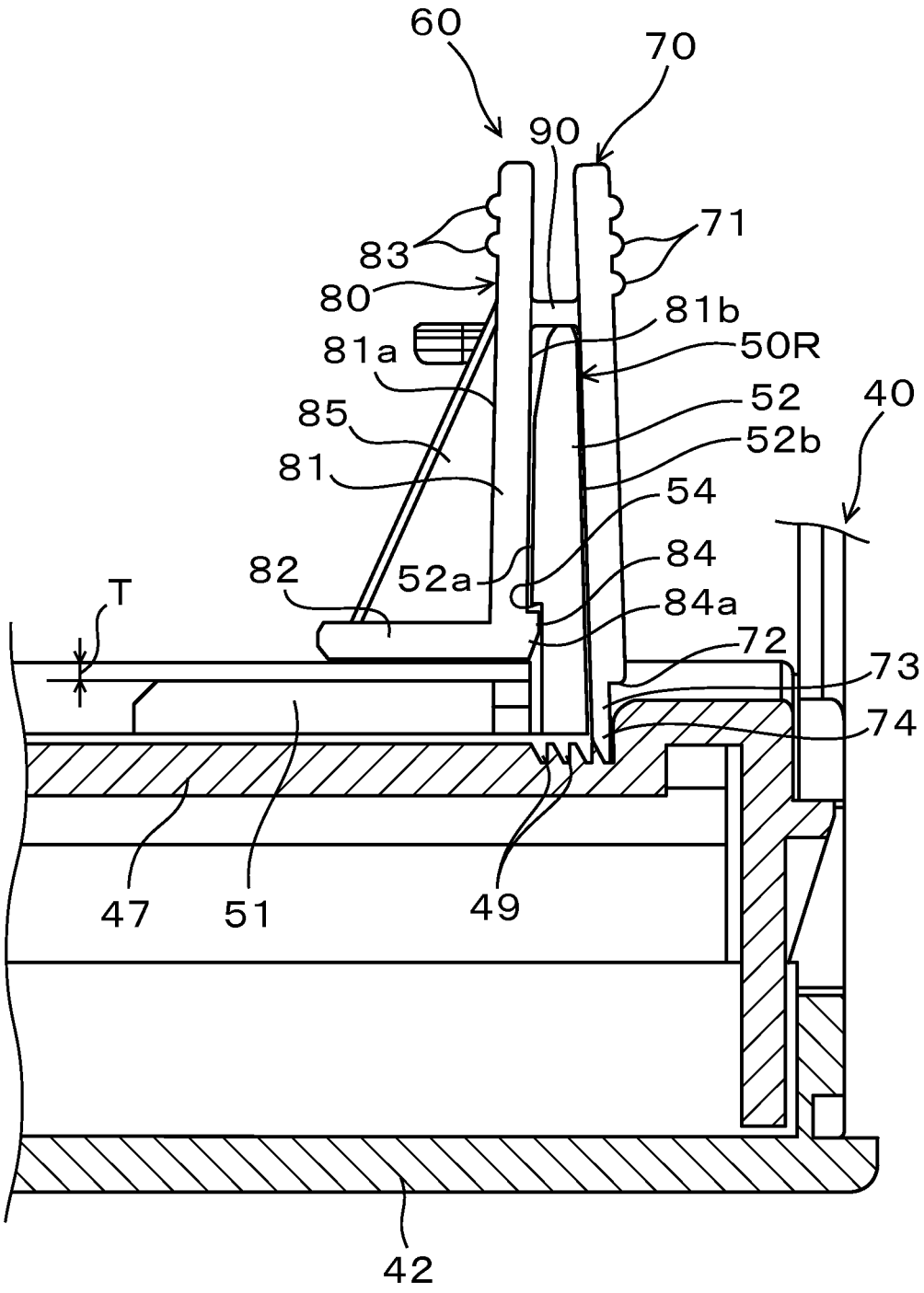
FIG. 7 is a sectional view showing the sheet feeding device, in a situation after the restricting member is attached to the side-fence, in accordance with the embodiment of the present disclosure.

Next, with reference to FIGS. 5-7, a procedure attaching the restricting members 60 to the side-fences 50F and 50R will be described. FIG. 5 is a sectional view showing a situation before the restricting member 60 is attached to the side-fence 50R. FIG. 6 is a sectional view showing a situation in the middle of attaching the restricting member 60 to the side-fence 50R. FIG. 7 is a sectional view showing a situation after the restricting member 60 is attached to the side-fence 50R. Incidentally, since attaching procedures of the front and rear side-fences 50F and 50R to the respective restricting members 60 are same, in the following, a procedure attaching the restricting member 60 to the rear side-fence 50R will be illustrated and described.

As shown in FIG. 5, above the downstream side (the left side) in the sheet conveying direction of the side part 52 of the side-fence 50R, the restricting member 60 is kept with a posture directing the first fixing part 70 outwardly, and then, the ribs 71 and the ribs 83 are grasped to spread the aperture 61 at the lower end against elastic force of the connection part 90.

In such a situation, as shown in FIG. 6, the aperture 61 of the restricting member 60 is fitted from the above to the side part 52 of the side-fence 50R and the restricting member 60 is taken down in an arrow direction in FIG. 6 along the side part 52. At this time, since the engaging claw part 84 of the second fixing part 80 is taken down so that the inclined face 84*a* goes along the inclined face 53 of the side-fence 50R, it is possible to easily attach the restricting member 60 to the side-fence 50R.

When the restricting member 60 is further taken down from a position shown in FIG. 6, as shown in FIG. 7, the engaging claw part 74 of the first fixing part 70 is engaged with each of the engaged recess parts 49 of the slide plate 47 of the manual bypass tray 40 and the restricting member 60 is attached to the side-fence 50R. Thereby, it is possible to restrict the side-fence 50R from moving in the sheet width direction (the forward and backward directions). That is, the engaging claw part 74 (an engaging part) of the first fixing part 70 is arranged at the lower end part of the first fixing part 70 so as to be engagable with the manual bypass tray 40, and then, to restrict slide of the side-fence 50R in the width direction by being engaged with the manual bypass tray 40. Incidentally, since the plurality of engaged recess parts 49 are formed in the forward and backward directions, it is possible to adjust a fixing position of the side-fence 50R in the forward and backward directions by optionally selecting an engaging position of the engaging claw part 74 with respect to the engaged recess parts 49.

In addition, at this time, the second engaging claw part 84 (a locking part) is engaged (locked) with the engaged recess part 54 at the inside face side of the side-fence 50R. Thereby, it is possible to prevent the restricting member 60 from coming off the side part 52 of the side-fence 50R and to surely fix the side-fence 50R by the restricting member 60.

Moreover, in such a situation where the restricting member 60 is attached to the side-fence 50R, between a lower face of the preventive portion 82 of the second fixing part 80 and an upper face of the based part 51 of the side-fence 50R, a gap T (e.g. its size is a thickness of one long sheet S), into which the long sheet S is inserted, made. That is, the preventive portion 82 is arranged to be separated upwardly from the manual bypass tray 40. Thereupon, in a case where the long sheet S is fed by the sheet feeding device 7, as shown in FIG. 8, the long sheet S is inserted into this gap T and set on the manual bypass tray 40.

As described above, in accordance with the sheet feeding device 7 according to the embodiment of the present disclosure, by attaching the restricting members to the side-fences 50F and 50R, it is possible to restrict movement of the side-fences 50F and 50R in the width direction and to prevent the long sheet S set on the manual bypass tray 40 from uplifting. Thereby, it is possible to prevent sheet feeding in a state that the long sheet S is skewed and to smoothly and surely convey the long sheet S to the apparatus main body 2. Moreover, by the abutting plate 85 of the restricting member 60, it is possible to prevent the long sheet S from being set on an upper side of the preventive portion 82 of the restricting member 60 as an irregular set position of the long sheet S.

In addition, since the restricting member 60 has simple structure, it is possible to easily carry out attaching/detaching work of the restricting member 60 to the side-fences 50F and 50R and to prevent trouble of placing of the restricting member 60 during nonuse.

Further, since the restricting member 60 is arranged at the downstream side in the conveying direction of the long sheet S on the side-fences 50F and 50R, it is possible to insert the long sheet S below the preventive portion 82 of the restricting member 60 while putting the long sheet S along the side-fences 50F and 50R and to easily carry out inserting work of the long sheet S. Moreover, since it is configured so that the engaging claw part 74 (the engaging part) of the restricting member 60 is engaged with the manual bypass tray 40 at the downstream side in the conveying direction of the long sheet S from the guide groove 48 guiding slide of the side-fences 50F and 50R, it is possible to prevent the slide action of the side-fences 50F and 50R from restraining unnecessarily when the long sheet S is set at the center in the width direction of the manual bypass tray by the side-fences 50F and 50R.

Figure 9:
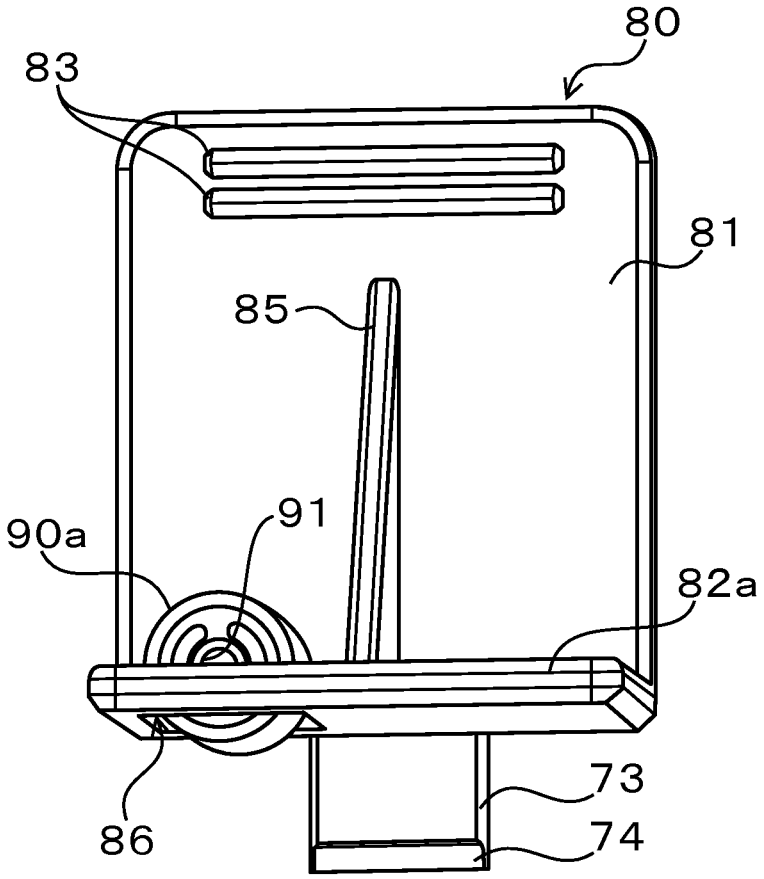
FIG. 9 is a perspective view showing the restricting member as a modified example in the sheet feeding device in accordance with the embodiment of the present disclosure.
Figure 10:
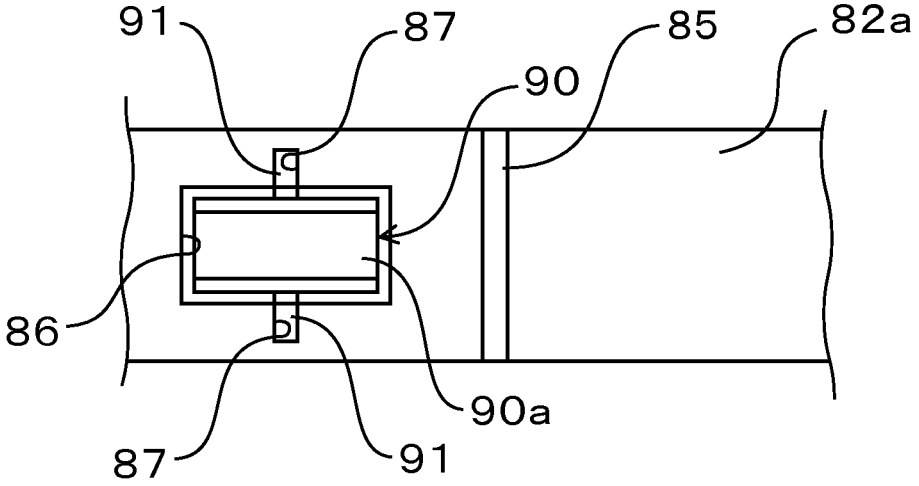
FIG. 10 is a plan view showing the restricting member device as a modified example in the sheet feeding device in accordance with the embodiment of the present disclosure.

Next, with reference to FIGS. 9 and 10, a modified example of the restricting member 60 of the sheet feeding device 7 according to the embodiment of the present disclosure will be described. FIG. 9 is a perspective view showing the modified example of the restricting member. FIG. 10 is a plan view showing the modified example of the restricting member.

In this modified example, a rectangular opening part 86 is formed at the downstream side (the left side) in the sheet conveying direction of a preventive portion 82*a* of the second fixing part 80 and half-columnar groove-parts 87 are formed at center parts of front and rear peripheral edges around the opening part 86 on an upper face of the preventive portion 82*a* so as to face to each other across the opening part 86. To the opening part 86, a rotation roller 90 as a weight part with a predetermined weight is supported (penetrated). The rotation roller 90 is composed of a cylindrical roller part 90*a* and a pair of shaft parts 91 projected at both end part of the roller part 90*a*. The rotation roller 90 is rotatably attached to the preventive portion 82*a* by fitting the shaft parts 91 to the groove parts 87. A lower end part of the roller part 90*a* is protruded downwardly from the opening part 86 to a position, in which the roller part 90*a* comes into pressure contact with an upper face of the long sheet S placed on the manual bypass tray 40.

By such a configuration, when the long sheet S is conveyed, since the lower end part of the roller part 90*a* comes into pressure contact with the upper face of the long sheet S placed on the manual bypass tray 40 and the rotation roller 90 is co-rotated according to conveyance of the long sheet S, it is possible to smoothly and surely send out the long sheet S in the conveying direction. Therefore, it is possible to easily convey the long sheet S to the apparatus main body 2 (refer to FIG. 1) in a stable state without skewing.

While the preferable embodiment and its modified example of the attachment mechanism of the optical scanning device and the image forming apparatus including this of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. A sheet feeding device comprising:

a manual bypass tray, on which a sheet conveyed to an apparatus main body is placed;

a pair of side-fences arranged slidable in a width direction orthogonal to a conveying direction of the sheet so as to approach to/separate from each other on the manual bypass tray; and restricting members arranged attachable to/detachable from the pair of side-fences, wherein each of the restricting members includes:

a first engaging part engaged with the manual bypass tray to restrict slide of each of the pair of side-fence in the width direction; and a preventive portion arranged so as to be separated upwardly from the manual bypass tray to prevent the sheet on the manual bypass tray from uplifting.

2. The sheet feeding device according to claim 1, wherein each of the pair of side-fences includes:

a based part formed along an upper face of the manual bypass tray; and a side part erected from an outside edge in the width direction of the based part, each of the restricting members includes:

a first fixing part arranged at a position facing to an outside face of the side part;

a second fixing part arranged at a position facing to an inside face of the side part; and a connection part connecting the first fixing part and the second fixing part, each of the restricting members configured so as to sandwich the side part by the first fixing part and the second fixing part, the first engaging part is arranged at a lower end part of the first fixing part to be engagable with a first engaged part arranged on the upper face of the manual bypass tray, the preventive portion is extended toward the inside in a horizontal direction on a lower end part of the second fixing part and arranged so as to face to the based part.

3. The sheet feeding device according to claim 2, wherein the preventive portion includes a weight part supported so as to come into pressure contact with the sheet on the manual bypass tray from the above.

4. The sheet feeding device according to claim 3, wherein the weight part includes a rotation roller co-rotating according to conveyance of the sheet.

5. The sheet feeding device according to claim 2, wherein the second fixing part includes a second engaging part engagable with a second engaged part arranged on an inside face of the side part.

6. The sheet feeding device according to claim 2, wherein each of the restricting members is arranged at a downstream side in the conveying direction of each of the pair of side-fences.

7. An image forming apparatus comprising:
the sheet feeding device according to claim 1.

8. An image forming apparatus comprising:
the sheet feeding device according to claim 2.

9. An image forming apparatus comprising:
the sheet feeding device according to claim 3.

10. An image forming apparatus comprising:
the sheet feeding device according to claim 4.

11. An image forming apparatus comprising:
the sheet feeding device according to claim 5.

12. An image forming apparatus comprising:
the sheet feeding device according to claim 6.

* * * * *